US005697661A

United States Patent [19]

Robinson, Sr. et al.

[11] Patent Number: 5,697,661

[45] Date of Patent: Dec. 16, 1997

[54] COMBINATION BAG CARRIER AND CLIP-ON DEVICE

[76] Inventors: William M. Robinson, Sr., 4001 E. University Ave., Gainesville, Fla. 32641; Joseph K. Robinson, 11 W. 32nd Ct., Riviera Beach, Fla. 33404; Belinda E. Robinson, 1008 10th Ter., Palm Beach Gardens, Fla. 33418

[21] Appl. No.: 582,337

[22] Filed: Jan. 18, 1996

Related U.S. Application Data

[63] Continuation-in-part of Ser. No. 381,120, Jan. 31, 1995, abandoned.

[51] Int. Cl.[6] ..... B65D 33/06

[52] U.S. Cl. ..... 294/142; 294/137; 294/158

[58] Field of Search ..... 294/137, 141–143, 294/152, 153, 158, 166, 170, 171; 16/114 R, 114 B; 383/6, 13, 25

[56] References Cited

U.S. PATENT DOCUMENTS

| | | | |
|---|---|---|---|
| 1,182,583 | 5/1916 | Nielsen | 294/137 |
| 3,226,147 | 12/1965 | Marshall | 294/143 X |
| 3,799,416 | 3/1974 | Schmaltz | 294/142 |
| 4,621,855 | 11/1986 | Kroll | 294/137 X |
| 5,150,938 | 9/1992 | Gans | 294/158 X |

FOREIGN PATENT DOCUMENTS

| | | | |
|---|---|---|---|
| 2632933 | 12/1989 | France | 294/137 |

*Primary Examiner*—Johnny D. Cherry

[57] ABSTRACT

A bag carrying and clip-on device, preferably of plastic, having a bag engaging portion for carrying multiple bags and a hand engaging portion formed so as to be comfortable to the hand of a wearer along with structure to facilitate the introduction and release of plastic bag handles to be held within the confines of the holder or carrier. The unique structure enables the device to be clipped onto a variety of surfaces particularly in the user's kitchen to enable the convenient unloading of bags by users.

3 Claims, 2 Drawing Sheets

COMBINATION BAG CARRIER AND CLIP-ON DEVICE

BACKGROUND OF THE INVENTION

The subject application is a continuation-in-part of Ser. No. 08/381,120 filed Jan. 31, 1995, now abandoned.

With the advent of plastic grocery bags of the "T-shirt" variety, a need has developed for holders/carriers which enable multiple bags to be carried comfortably by individuals, particularly women. Plastic bags are now widely used in grocery stores, as well as variety, five and ten, and various other high volume types of stores.

Over the past decade, plastic bags have become a significant replacement for paper bags in high volume stores, including grocery and variety stores. One advantage of plastic bags is that with the type of "T-shirt" handle, multiple bags can be carried as such bags can either be gripped in one's hand or slung over one's wrist. The disadvantage of such use, however, is that carrying multiple bags by one's hand or over one's wrist or arm can be very uncomfortable when the weight of the bags is significant or the distance for carrying the bags is great.

A series of patents have been issued relating to bag carriers where attempts have been made to eliminate the difficulty in carrying multiple bags. For example, U.S. Pat. No. 4,772,059 discloses a bag carrier wherein the patentee recognized the problem of individuals carrying bags. A device was fashioned to alleviate the gripping problems of the person carrying the bags. The device of U.S. Pat. No. 4,772,059 has a significant disadvantage in that a cumbersome latching mechanism is involved which detracts from the usefulness of the item.

Thus, in using the device of U.S. Pat. No. 4,772,059, the clamp means must physically be released as bags are placed within the carrier, latched when bags are to be carried and released once again when carrying is completed.

In U.S. Pat. No. 5,150,938, once again there must be positive steps taken to open and close the catch means (carrying means, 14 as connected to lock means 18). Upon engagement and disengagement of the bags, the release means must be physically taken by the hand, pulled away from the carrying means for engagement within the slot, all of which steps are time-consuming and cumbersome.

U.S. Pat. No. 4,936,619 is designed so as to avoid latching problems, but has additional problems such as having a cumbersome overall design which makes the item bulky to carry when not in use.

U.S. Pat. No. 1,182,583 is of somewhat similar design but cannot be used as a clip-on device for unloading purposes as will be discussed.

French Patent 2,632,933 (December 1989) is similar in some respects to U.S. Pat. No. 1,182,583 but also cannot be used as a combination-clip-on device.

SUMMARY OF THE INVENTION

Applicant has overcome the deficiencies of the above-cited references by designing a unitary member which provides for easy engagement and release of the bags, positive holding means of the bags, and a convenient hand carrying means. This is all achieved through the use of an improved design eliminating completely the steps of engagement and disengagement of a latching means which one would find cumbersome in the earlier designs.

Applicant has also substantially reduced the costs of producing such a bag holder by designing a unitary device to eliminate the need of different materials such as necessitated in U.S. Pat. No. 5,150,938, as well as also required for U.S. Pat. No. 4,772,059. Both of these references disclose the use of plastic and/or metal, wood, plastic, or rope. Substitutes can be made for the materials, but in each case multiple materials are required to carry out the objectives of U.S. Pat. Nos. 4,772,059 and 5,150,938.

Applicant's relatively simple design avoids the cumbersome nature of the device of U.S. Pat. No. 4,936,619. Further, the construction of the device disclosed in U.S. Pat. No. 4,936,619 involves sophisticated molding which does not enhance to commercial feasibility of the design.

None of the references discussed above can also serve as a clip-on device to allow bags to be hung conveniently to closets, pantry shelves or refrigerators for unloading.

Accordingly, it is an object of the present invention to develop a bag holder which is commercially viable for the intended purpose.

It is the further object of the subject invention to provide a bag holder which can be conveniently held in one's hand.

It is still another object of the present invention to develop a bag holder constructed of a single material, preferably plastic which can be formed inexpensively.

It is still another object of the subject invention to provide a bag carrier which has a simple design so as to be easily stored or carried when it is not in use.

It is but another object of the subject invention to provide a carrier which does not have a cumbersome engagement and release structure.

It is one more object of the subject invention to provide a bag carrier which can also serve as a clip-on device to be conveniently secured to surrounding structures enabling the quick and efficient removal of items from the carried bags.

Further features of the invention will be appreciated and better understood from the following description and the accompanying drawings. The drawings are for the purpose of illustration and do not limit the invention.

DETAILED SPECIFICATIONS

Figure 1:
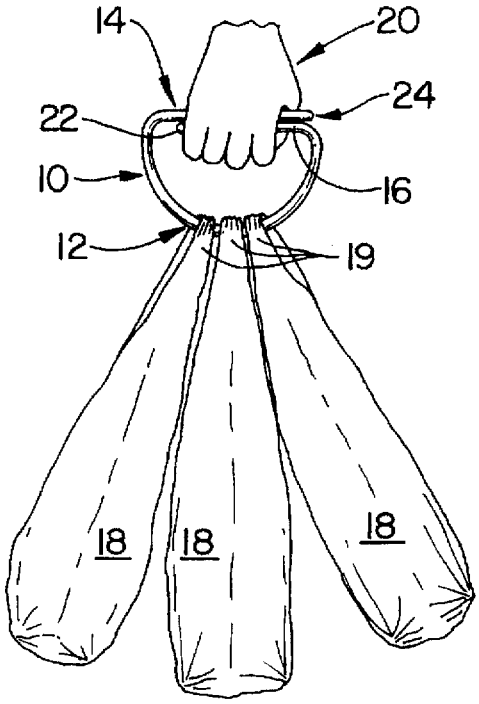
FIG. 1 is a perspective view showing the bag holder/carrier in use, i.e., with bags held or carried by a user.

The preferred embodiment of Applicant's invention is shown in FIG. 1 where a bag holder 10 generally comprises a bag carrying surface 12 and hand holding portions 14 and 16. Bags 18, having handles 19, are shown being carried by the bag carrier 10, along with the hand of the user 20.

The hand holding portions 14 and 16 can be seen to be the extremities of the unitary holder 10 which is shaped so as to accommodate both the carrying of the bags 18 and the holding of the carrier 10 by hand 20.

The bags 18 are conveniently carried in the curvilinear portion 12 whereas in the preferred structure, the hand holding section, portions 14 and 16, are straight portions to facilitate carrying of the device. Each of the portions 14 and 16 has a respective end 22 and 24. End 22 is shaped to be close to opposing portion 14, while end 24 is shaped to be close to portion 16.

Figure 2:
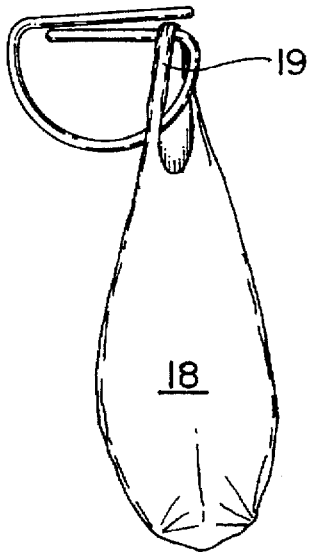
FIG. 2 is a frontal elevational view showing a bag being inserted onto a holder.
Figure 3:
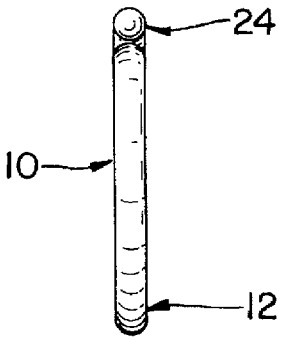
FIG. 3 is an end elevational view of the bag holder without bags.
Figure 4:
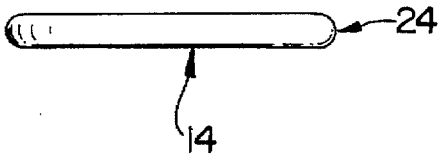
FIG. 4 is a top view of the bag holder.

As best seen in FIGS. 2–4, bags having T-shirt handles 19 can be inserted into holder 10 by pulling a portion of handle structure 19 between the portions 14 and 16.

It is contemplated that bag carrier 10 is constructed of a somewhat rigid but high density high memory material such as a polyproplyene co-polymer blend product so that with some pliability, sections 14 and 16 can be easily separated to pull the bag handles 19 between the two, thus engaging them within the holder 10 to bear against lower portion 12 so that they can be carried easily and securely when portions 14 and 16 are gripped by hand.

Thus, it can easily be appreciated that one will take a bag 18 with handles 19, slide it along either surfaces 14 or 16 from respective ends 22 or 24, such that upon clearance of the linear portion 14/16, the bag slips into the curvilinear portion 12 where it is secured for carrying purposes. In this way multiple bags can be placed within the carrier in quick succession with a minimum of effort, i.e., simply sliding the handles along the linear portions 14, 16 until they slide to within the curvilinear lower portion 12. Many bags 18 can be placed into the holder 10 with the primary limitation being the weight of the bags with regard to the strength of the person carrying the device as physically quite a number can be easily held by the holder 10.

It can be appreciated that in use, a person may grip one of portions 14 or 16, allowing for bag handles 19 to be slid between portions 14 and 16. The bag handles 19 are guided between the portions 14 and 16 until they come within the closure formed by the combination of portions 14 and 16, and can come to rest on the curvilinear portion 12 which becomes the surface on which handles 19 rest while bags are carried.

Once all bags 18 to be carried have been placed within holder 10 in the matter just described, the user grips both portions 14 and 16, which together become gripping means. Thus, the bags can be comfortably carried for even long distances without the discomfort of holding multiple plastic bags in one's hand or draped over a wrist or arm.

Once the bags are carried to their destination, they can be removed from carrier 10 by taking the handles 19 and sliding them between portions 14, 16 with a minimum of difficulty.

Figure 5:
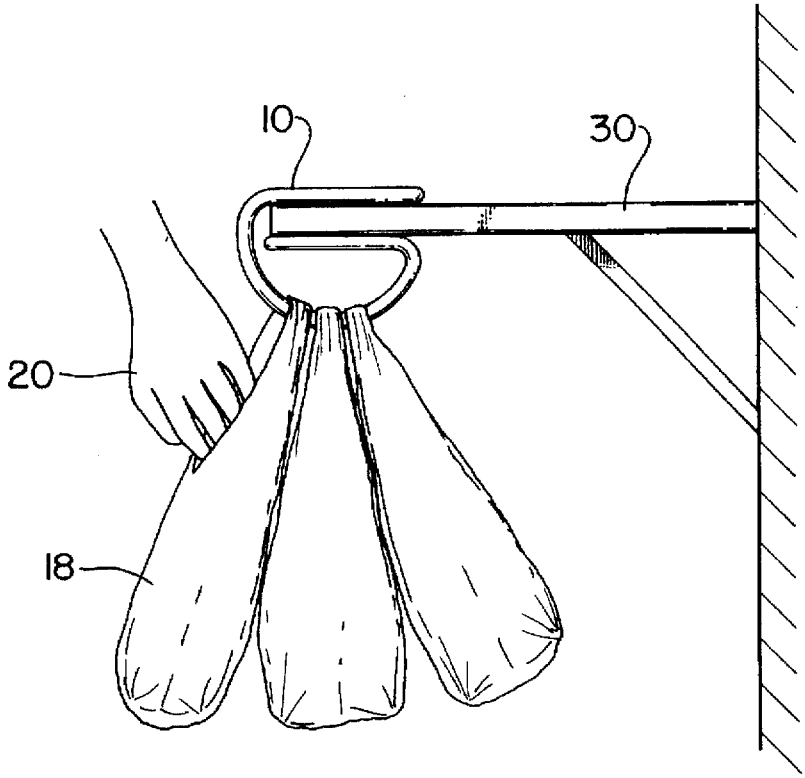
FIG. 5 is a side view of a pantry shelf showing the bag carrier clipped-on to facilitate item removal.

Furthermore, as shown in FIG. 5 the carrier 10 can be secured to a shelf 30 in a pantry, closet, refrigerator or other location to facilitate unloading the items in the bags. Valuable time and exertion can be saved by conveniently placing the items near to their storage location to save repetitive trips from other locations as for example, a nearby table where bags might be laid for unloading without the benefit of the carrier-clip-on device 10.

Some individuals might have bag unloading habits in which they lay the bags on the floor. The carrier clip-on device 10 can be attached to shelving or any horizontal surface at a level convenient for unloading, saving the user from potential back or other physical discomfort.

Figure 6:
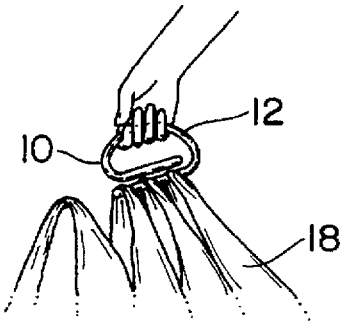
FIG. 6 is a frontal elevational view showing the first step of bags being loaded onto the carrier.
Figure 7:
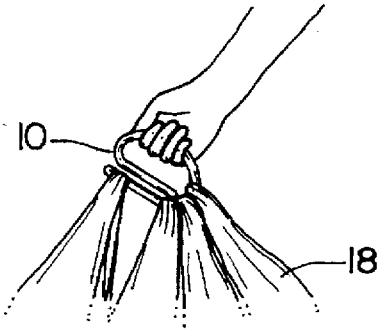
FIG. 7 is a sequential view showing the second step of bags being loaded onto the carrier.
Figure 8:
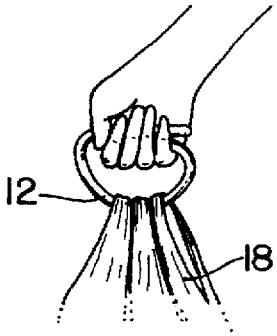
FIG. 8 is another sequential view showing the final carrying position with bags in position to be carried.

With reference to FIGS. 6–8, the carrier 10 is shown first gripped by the curvilinear lower portion 12 to "scoop up" bags 18 (FIG. 6). As shown in FIG. 7 the carrier 10 is tilted to allow the bags 18 to slide further onto the carrier 10. As shown in FIG. 8 the carrier 10 is slid around to its carrying position with the bags 18 now resting on the curvilinear portion 12.

This invention can be embodied in other forms without departing from the spirit and essential attributes thereof, and accordingly, reference should be had to the following claims, rather than to the foregoing specification, as indicating the scope of the invention.

We claim:

1. A bag carrier which can also be clipped onto a support surface comprising a unitary member shaped to include:

a first portion that combines as a hand holding and first means for engaging a first surface of a support member;

a second portion that is a bag carrying portion; and a third portion that combines as a hand holding and second means for engaging a second surface of a support member, said second surface facing in an opposite direction from said first surface whereby handles of bags are engaged by said first or third portion and shifted to the bag carrying portion against said second portion enabling said first and third portions to be gripped together to become hand holding means enabling bags to be carried by the holder, whereby said first and third portions together provide clip-on structure to enable said carrier to be attached to a support surface to facilitate unloading items from within the bags.

2. A method of handling bags utilizing a bag carrier having:

a first portion that combines as a hand holding and engagement means;

a second portion that is a bag carrying portion; and a third portion that also combines as a hand holding and engagement means, whereby handles of bags are engaged by said first or third portion and shifted to the bag carrying portion against said second portion enabling said first and third portions to be gripped together to become hand holding means enabling bags to be carried by the holder, comprising the steps of:

loading the bags onto the carrier;

carrying the bags by grasping the carrier to a destination and;

attaching the carrier to an object by sliding said first portion along one surface of said object and sliding said third portion along a second surface of said object to slip said carrier on said object to enable items to be unloaded from said bags.

3. The method of claim 2 wherein the step of loading further comprising the steps of:

grasping the carrier by the second portion and scooping the bags onto the carrier over said first or third portion;

tilting the carrier to slide the bags toward the second portion; and grasping the carrier by the first and third portions to carry the bags on the second portion.

* * * * *